US005921251A

United States Patent [19]

Joshi

[11] Patent Number: 5,921,251

[45] Date of Patent: Jul. 13, 1999

[54] BRUSH THAT DELIVERS BENEFICIAL AGENTS

[75] Inventor: Ashok V. Joshi, Salt Lake City, Utah

[73] Assignee: Ceramatec, Inc., Salt Lake City, Utah

[21] Appl. No.: 08/908,542

[22] Filed: Aug. 7, 1997

[51] Int. Cl.[6] ..... A46B 11/00

[52] U.S. Cl. ..... 132/112; 132/148; 132/311; 433/216; 15/167.1

[58] Field of Search ..... 132/308, 311, 132/148, 112, 113, 114, 115, 116; 15/167.1; 433/29, 89, 216

[56] References Cited

U.S. PATENT DOCUMENTS

| | | | |
|---|---|---|---|
| 3,261,978 | 7/1966 | Brenman | 15/167.1 |
| 3,478,741 | 11/1969 | Simor | 15/167.1 |
| 3,520,297 | 7/1970 | Bechtold | 132/308 |
| 4,277,194 | 7/1981 | Smith . | |
| 4,507,285 | 3/1985 | Kuhne . | |
| 4,538,631 | 9/1985 | Prince | 15/167.1 |
| 4,632,135 | 12/1986 | Lenting et al. | 132/313 |
| 4,691,718 | 9/1987 | Sakuma et al. | 15/167.1 |
| 4,695,177 | 9/1987 | Kuo . | |
| 4,698,360 | 10/1987 | Masquelier . | |
| 4,733,983 | 3/1988 | Hertrampf . | |
| 4,787,765 | 11/1988 | Kuo . | |
| 4,875,473 | 10/1989 | Alvarez . | |
| 4,902,278 | 2/1990 | Maget et al. . | |
| 4,910,014 | 3/1990 | Nakagawa . | |
| 4,921,475 | 5/1990 | Sibalis . | |
| 4,969,868 | 11/1990 | Wang | 15/167.1 |
| 4,969,881 | 11/1990 | Viesturs . | |
| 5,017,036 | 5/1991 | Vidovic . | |
| 5,062,728 | 11/1991 | Kuo . | |
| 5,096,321 | 3/1992 | Mountain . | |
| 5,302,374 | 4/1994 | Wagner | 424/52 |
| 5,306,143 | 4/1994 | Levy | 433/29 |

(List continued on next page.)

OTHER PUBLICATIONS

Gummow et al., "An Investigation of Spinel–Related and Orthorhombic $LiMnO_2$ Cathodes for Rechargeable Lithium Batteries", *J. Electrochem. Soc.,* vol. 141, No. 5, May 1994, pp. 1178–1179.

Ibl et al., "Comprehensive Treatise of Electrochemistry vol. 2: Electrochemical Processing", *Inorganic Electrosynthesis,* pp. 165–167, 226–231, 236–250.

Tatapudi et al., "Simultaneous Synthesis of Ozone and Hydrogen Peroxide in a Proton–Exchange–Membrane Electrochemical Reactor", *J. Electrochem. Soc.,* vol. 141, No. 5, May 1994, pp. 1174–1177.

S.P.M. Recovery Technologies Ltd., "Highly Efficient Ozone–Based Wounds Healing Technology", Brochure, 5 pages.

*Primary Examiner*—Todd E. Manahan
*Attorney, Agent, or Firm*—Factor and Shaftal

[57] ABSTRACT

A brush having a handle and associated surface application portion, which brush handle contains a beneficial agent generator. The brush typically has a stem with first and second ends, the first end serving as a handle. Bristles are associated with the stem's second end. A beneficial agent generator (such as an electrochemical gas generating cell) that generates a fluid comprising an oxidizing agent is encased within the stem. For treating teeth, the generator will generally be chosen to generate an oxidizing agent such as a peroxide, ozone, oxygen, or mixtures thereof. When the generator requires it, the brush will also include a battery and a switch associated with the stem and in electrical contact with the generator. The switch may be associated with the first stem end and will be in operable (e.g., electrical) contact with the electrochemical gas generating cell and the battery. When the brush is used to brush teeth, it will generally also include a vent or port, in fluid communication with the electrochemical gas generating cell, for venting undesired fluids (e.g., hydrogen gas) from the second end of the toothbrush, such as the first stem end. The invention may be used in various useful methods such as cleaning, bleaching, and sanitizing tooth or other surfaces.

36 Claims, 3 Drawing Sheets

U.S. PATENT DOCUMENTS 5,309,590 5/1994 Giliani et al. .
5,311,632 5/1994 Center .
5,326,444 7/1994 Nakamatsu et al. .
5,338,412 8/1994 Burk et al. .
5,346,324 9/1994 Kuo .
5,372,501 12/1994 Shalvi ..... 15/167.1
5,393,153 2/1995 Bouthillier et al. .
5,403,105 4/1995 Jameson .
5,407,287 4/1995 Braun et al. .
5,427,870 6/1995 Joshi et al. .
5,435,034 7/1995 Bigler et al. .
5,439,014 8/1995 Moussa .
5,448,151 9/1995 Ganse et al. .
5,463,792 11/1995 Hogan et al. ..... 132/308
5,476,384 12/1995 Giuliani et al. .
5,553,747 9/1996 Raba et al. .
5,578,022 11/1996 Scherson et al. .
5,624,667 4/1997 Maruo et al. .
5,636,933 6/1997 Vizsolyi .

BRUSH THAT DELIVERS BENEFICIAL AGENTS

TECHNICAL FIELD

This invention generally relates to surface treatment devices like brushes, especially toothbrushes, adapted to deliver or generate beneficial agents for application to a surface, and associated methods useful for treating that surface.

BACKGROUND

Heretofore, changes in the chemical composition of materials such as toothpaste which are to be applied to a surface have been generally achieved by modifying the chemical composition itself. Such an approach, while adequate for most applications, may be inadequate for certain applications where compounds such as highly reactive chemical species (e.g., oxidizing agents) are desired to be applied to the surface. If the highly reactive chemical species are incorporated into the chemical composition itself (e.g., the highly reactive chemical species is incorporated into a toothpaste formulation), by the time the chemical composition is used, the highly reactive chemical species might already have reacted to be reduced or otherwise neutralized.

It would thus be an improvement in the art to be able to include various highly reactive chemical species into a formulation at the time of its use (or immediately before the time of its use) so as to allow insufficient time for the highly reactive chemical species to decompose or otherwise be neutralized in order to achieve more effective treatment of the surface. It would also be an improvement in the art to have some means for improving a surface treatment compound's penetration into a surface or crevices in the surface.

DISCLOSURE OF THE INVENTION

The invention includes a brush having a handle and associated surface application portion (e.g., bristles), which brush contains or is otherwise associated with a particular beneficial agent generator that delivers the beneficial agent to the surface application portion of the brush. The inventive brush may also be associated with other devices such as an ultrasonic wave generator for further enhancing the brush's treatment capabilities, especially in the areas of cleaning and disinfection.

The invention thus includes a brush having a stem with first and second ends, the first end serving as a handle. Bristles are associated with the stem's second end, and are oriented and affixed to the stem for application to, for example, a user's teeth. A fluid generator which generates a beneficial fluid comprising an oxidizing agent (such as an electrochemical gas generating cell which generates oxygen, ozone, carbon dioxide, hydrogen peroide, or mixtures thereof) is encased within the stem, which fluid generator is in fluid communication with the bristles so as to deliver beneficial fluid to the bristles. An aerating agent, such as carbon dioxide might also be generated either by the fluid generator or by other means associated with the brush (e.g., utilization of an effervescent solution). For bleaching or cleaning teeth or disinfecting the gums, the fluid generator will generally be selected to generate an agent such as a highly reactive chemical agent (e.g., an oxidizing agent chosen from the group of oxidizing agents consisting of peroxides, ozone, oxygen and mixtures thereof).

When the fluid generator requires a separate source of power, as is the case with certain electrochemical gas generating cells, the brush will also typically include or be operably electrically associated with a battery or other power source and a switch or equivalent means for activating and deactivating the electrochemical gas generating cell. The switch will typically be associated with the stem's first end, and will be in electrical contact with the electrochemical gas generating cell. The switch may be associated with the stem's first end and will be in operable (e.g., electrical) connection with the electrochemical gas generating cell and the battery.

When the brush is used for brushing teeth and the fluid generator is an electrochemical gas generating cell, the brush will generally also include a vent, in fluid communication with the electrochemical gas generating cell, for venting undesired fluids (e.g., hydrogen gas) from the second end of the toothbrush, such as the stem's first end. The vent may also provide access to the outside atmosphere (i.e., the air) if the particular cell used utilizes an outside oxygen source as is the case of a corona discharge ceramic cell for generating ozone.

The invention may be used in various useful methods such as cleaning, bleaching, and sanitizing teeth, gingival exteriors or other oral surfaces such as the tongue. The oxidizing agents are also known to aid in wound healing and, in the case of hydrogen peroxide, bleach teeth. The invention thus also includes a method of treating an oral surface involving using the aforementioned brush in the form of a toothbrush and brushing the oral cavity with the bristles over a period of time (e.g., 30 seconds to 10 minutes) to treat the oral surface.

BRIEF DESCRIPTION OF THE FIGURES

In the drawings, which depict presently preferred embodiments of the invention and in which like reference numerals refer to like parts in different views.

BEST MODE OF THE INVENTION

Figure 1:
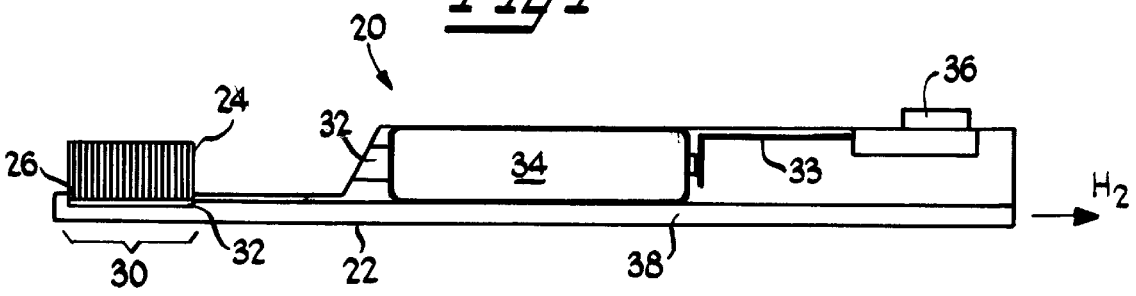
FIG. 1 depicts a cut away, side view of a toothbrush made according to the invention.
Figure 2:
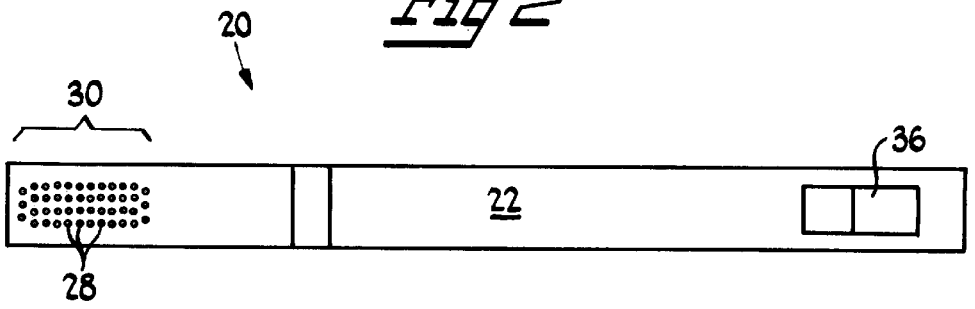
FIG. 2 is a top view of the toothbrush of the preceding figure.

Referring now to the figures, wherein the showings are for purposes of illustrating the invention, and not for the purpose of limiting the invention, the figures show a novel and versatile brush. As depicted in FIGS. 1 & 2, a preferred device according to the invention, generally 20, is shaped similarly to a traditional toothbrush, having a similar length and other dimensions. The toothbrush 20 includes a longitudinal stem 22 to which at one end is associated (e.g., adhered, molded into, or otherwise physically associated with) a series of bristles 24 oriented for application to a surface to be treated with the toothbrush 20.

Figure 6:
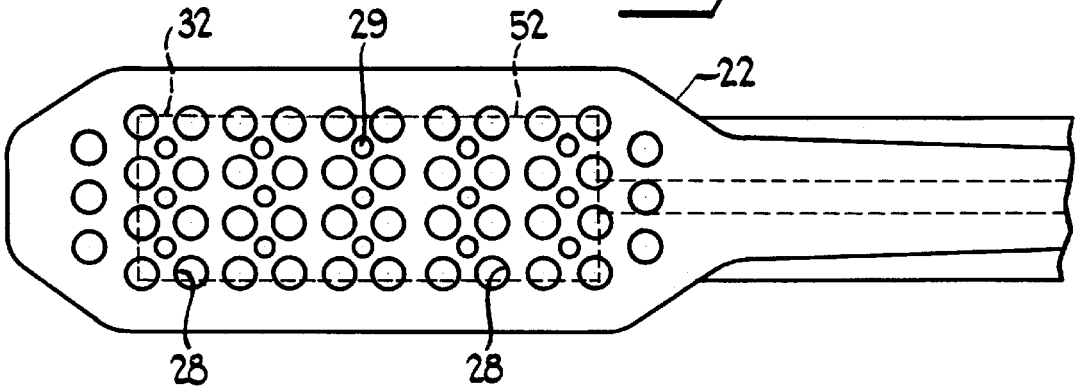
FIG. 6 depicts a close-up of the bristle portion an embodiment of the invention.

In the embodiment depicted in FIGS. 1 & 2, the bristle bottoms 26 are placed in holes 28 formed (or bored) in the bristle end 30 of the stem 22. In the embodiment depicted in FIGS. 1 & 2, positioned underneath the bristle bottoms 26 is an electrochemical cell 32 for generating an oxidizing gas. Alternatively, the gas generator 32 may be merely in fluid communication with the bristle bottoms. The cell 32 is oriented (with or without a hereinafter described catalyst) so as to produce an oxidizing gas on the surface of the cell 32 proximal the apertures 28 containing the bristle bottoms 26. In the depicted embodiment, extra apertures 29 are placed in the bristle end 30 of the stem 22 (FIG. 6). These extra apertures are not associated with a bristle, and thus allow oxidizing agent to pass through the toothbrush stem from the electrochemical gas generating cell to an area proximate the bristles 24. A chamber may be positioned between said electrochemical gas generating cell and the bristle bottoms. In an alternative embodiment (not shown), the bristle bottoms do not completely fill the bristle apertures, thus allowing the gas containing oxidizing agent to seep pass the bristle bottoms onto the tooth surfaces.

Figure 4:
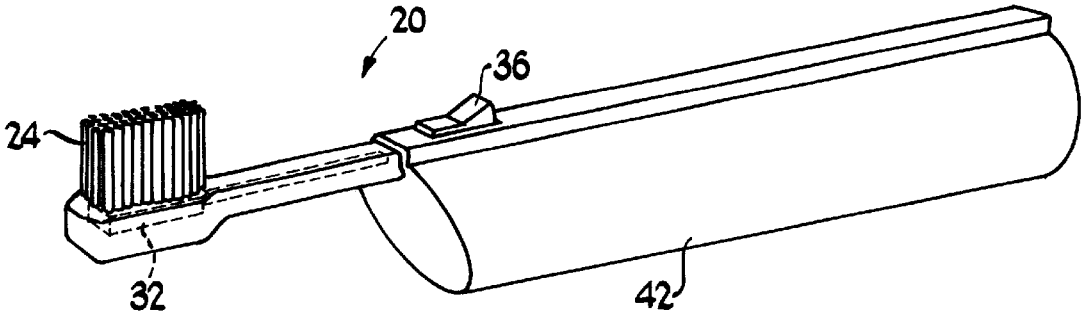
FIG. 4 depicts a side view of one embodiment of the invention.
Figure 5:
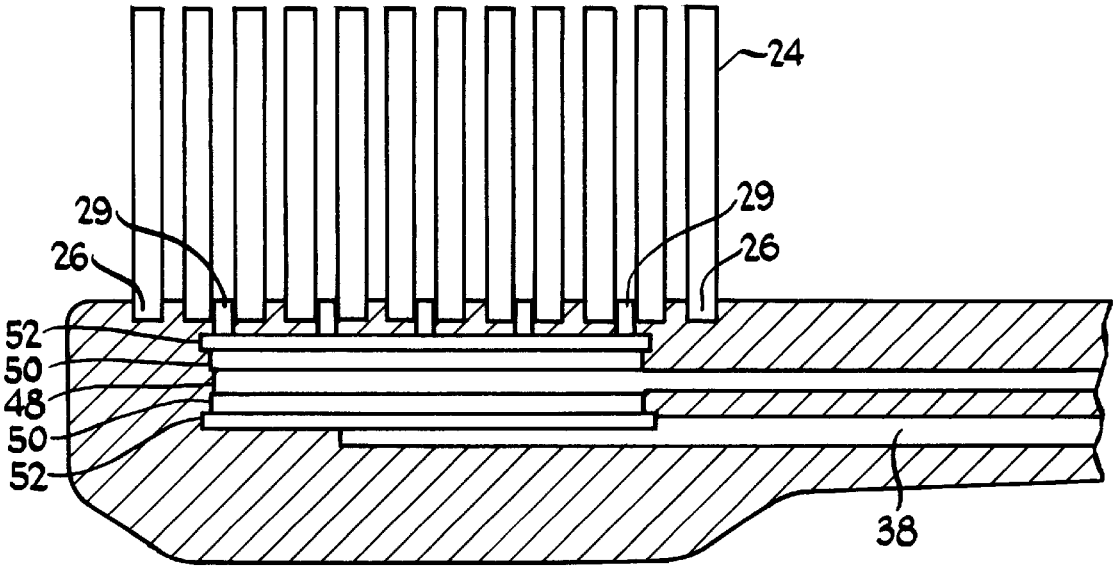
FIG. 5 depicts a close-up of the bristle portion of the embodiment of the preceding figure.

The oxidizing agent generating portion of the device preferably generates oxygen electrochemically. In such a case (see, e.g., FIGS. 4 & 5), the electrochemical cell will typically include a cathode 48 for reducing oxygen in a feed gas to negative ions, neutral species, or mixtures thereof; a, for example, Nafion electrolyte 50 for diffusing the negative ions, neutral species or mixtures thereof therethrough; and an anode 52 communicating with the electrolyte 50 for oxidizing the negative ions, neutral species or mixtures thereof to produce a high concentration oxygen for supply via the extra apertures 29 to the tooth's surface. The production of oxygen will typically occur according to a one, two or four electron process. The negative ions can be peroxide ions in their various protonated and unprotonated forms, superoxide ions including their protonated forms, or hydroxyl ions (e.g., if the overall process involves the electrolysis of water).

The oxidizing agent generating device can be of the type that generates oxygen according to an electrochemical process which involves a power source (e.g., a primary or rechargeable battery) which applies a potential difference between the cathode and the anode to concentrate oxygen from ambient air which may be introduced via the exhaust port 38 or the apertures 29.

In various embodiments, the oxidizing agent generating portion of the device can be the previously described electrochemical cell which generates, for example, oxygen, hydrogen peroxide, ozone, or mixtures of various components thereof. The oxidizing agent generating portion of the device could alternatively be an ozone-generating cell such as the type which uses a dielectric (e.g., alumina) powered by, for example, batteries.

Figure 7:
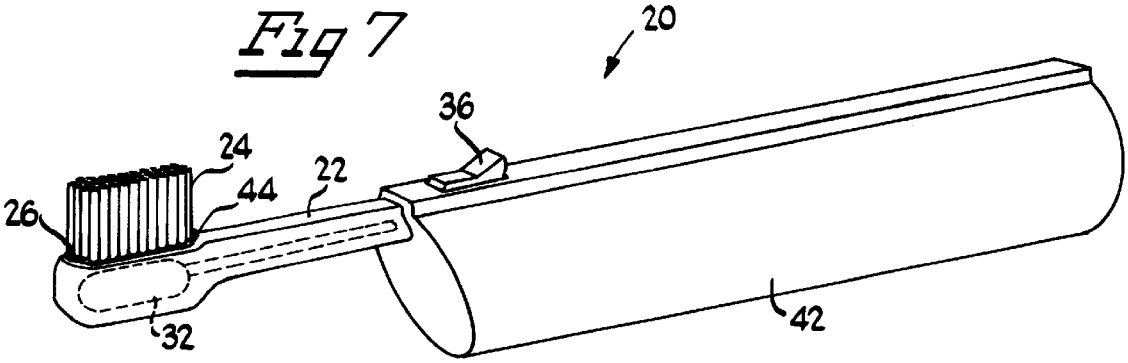
FIG. 7 depicts a side view of another embodiment of the invention.
Figure 8:
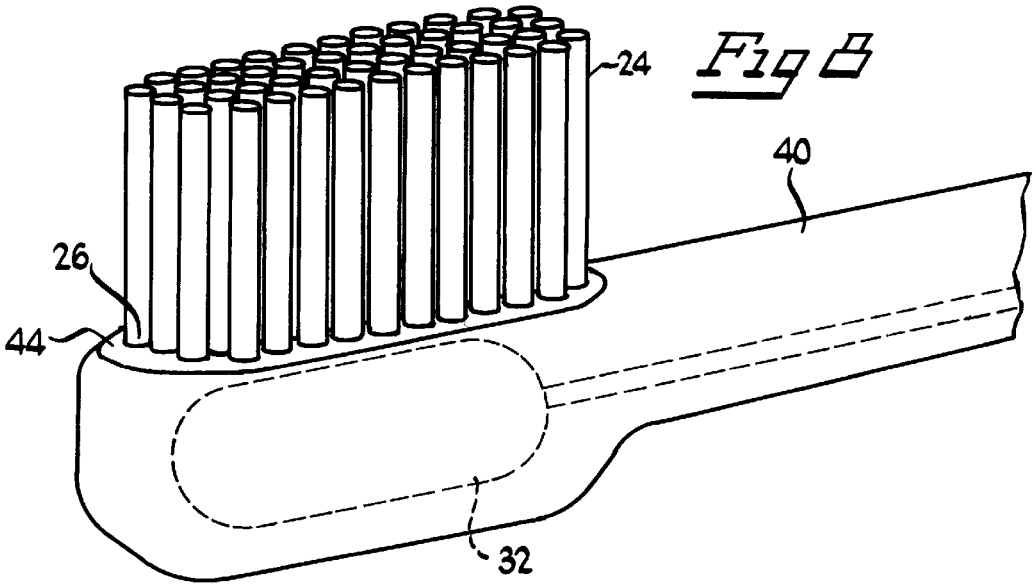
FIG. 8 depicts a close-up of the bristle portion of the embodiment of the preceding figure.

Alternatively, and as depicted in FIGS. 7 and 8, the oxidizing agent generating portion can be a photoelectrochemical cell 32' whereby water is decomposed to generate oxygen and hydroxyl ions or ozone. The photoelectrochemical cell 32' incorporates a catalyst 44 (e.g., $TiO_2$ or a $TiO_2$—$NbO_2$ solid solution) together with a light source (e.g. a lamp 46 such as an ozone producing lamp available from Jetlight Company, Inc. of Irvine, Calif. or Light Sources, Inc. of Orange, Conn.) which generates an appropriate frequency of light (e.g., from 180 nanometers to about 1000 nanometers) onto the catalyst 44 in the presence of water to generate oxidizing agents wherein the light source (e.g., a lamp) is powered by batteries or other power source encased within the handle portion 42 (not shown).

In the embodiment depicted in FIGS. 1 & 2, the electrochemical cell 32 is electronically connected with (e.g., by electrical circuitry such as metal wires) to a battery 34 or other power source for providing power for the electrochemical gas generating cell 32. The battery 34 or batteries may be standard batteries, readily commercially available, and are preferably rechargeable batteries, such as nickel-cadmium or lithium batteries.

In the embodiment depicted in FIGS. 1 & 2, electrical circuitry 33 includes a switch 36 which interconnects the gas generating cell 32 and the battery 34 by electrical circuitry. The switch is preferably placed for easy actuation by the user.

Rather than a switch, the toothbrush may be associated with a toothbrush holder or other structure having electrodes or other electronic circuitry oriented or configured to deactivate the electrochemical gas generation cell when the toothbrush is being held by the toothbrush holder or other structure, but which automatically actuates the device when the toothbrush is removed from the toothbrush holder (not shown).

In the depicted embodiment, the electrochemical gas generating cell is also oriented so that gases which may not be desired (e.g., hydrogen gas), but which are nonetheless generated by the electrochemical gas generating cell are not exhausted through the apertures 28, but instead are exhausted out of an exhaust port 38 which is not intended to be placed within the user's mouth. With certain hereinafter described electrochemical gas generating cells, the exhaust port may also serve to provide fluid communication between the cell and the outside atmosphere which may be needed for the cell to work properly.

Figure 3:
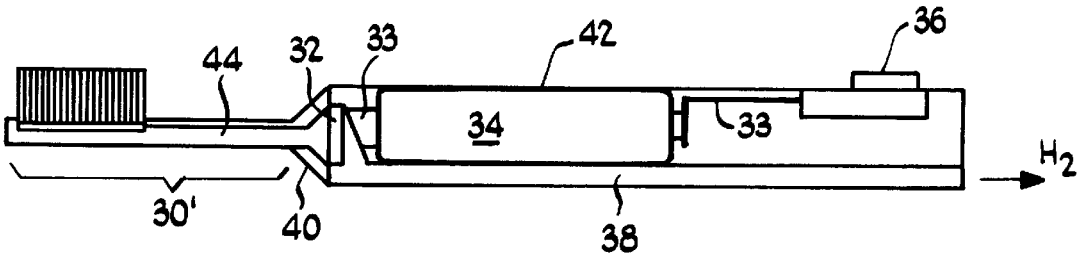
FIG. 3 depicts a cut away, side view of an alternative embodiment of the invention.

In the embodiment depicted in FIG. 3, the stem is made of two portions, a bristle portion 40, and a handle portion 42 which interconnect one with the other (e.g., by interacting male/female threads associated with the respective interacting ends of each portion) in fluid tight relationship to form the toothbrush stem. The bristle portion 40 has the bristle end 30' and means, such as a tubular portion 44 formed in the bristle portion 40, for providing fluid communication between the electrochemical cell 32 and the apertures in the bristle portion 40. The electrochemical cell 32 is oriented in the device of FIG. 3 so as to direct undesired gases out of the exhaust port 38; not into the user's mouth. In such an embodiment, the bristle portion 40 may be disposable, while the handle portion 42 may be reused.

An electrochemical gas generating cell based on "Nafion" solid polymer electrolyte (e.g., a perfluoro sulfonic polymer) may be used. In such a case, the electrodes and catalysts on the Nafion are selected so that on the portion in fluid communication with the bristles, the chosen oxidizing agent will be generated. In an electrochemical cell, oxygen can be electrochemically released from a solid anode material of the general form $A_xO_y$ as A ions migrate across a suitable ion-conducting electrolyte as described in U.S. Pat. No. 5,427,870 to Joshi et al. (Jun. 27, 1995). Alternatively, electrochemical cells such as those disclosed in U.S. Pat. No. 5,454,922, U.S. Pat. No. 5,538,605, or U.S. Pat. No. 5,593,552 may be used. Generally the reaction proceeds as $4\ H_2O \rightarrow O_2 + H_2O_2 + 6\ H$ at the bristle side, while at the exhaust side the reaction proceeds as $6\ H \rightarrow 3\ H_2 + 6\ e^-$. The particular oxidizing agent generated by the cell can be modified (e.g., to produce ozone) by modifying the voltage applied to the cell, and/or using an appropriate catalyst such as platinum, titania, or lead oxide. When such an electrochemical cell is used, a battery is not necessary to power the device.

Alternatively, electrochemical cells such as those disclosed in U.S. Pat. Nos. 4,522,698 (June 1985), 4,886,514, and 4,902, 278 (Feb. 20, 1990) to Maget et al. may be used in the device, however, in such an instance a battery or other power source may be necessary to power the device, and the previously described exhaust may be used to serve the dual purpose of exposing the cell to the air as well as exhausting undesirable gases. Alternatively, another communication port between the electrochemical gas generating cell and the outside atmosphere may be formed in the device.

The production of hydrogen peroxide by electrochemical means is described in, among other places, the *Comprehensive Treatise of Electrochemistry, Vol. 2: Electrochemical Processing*, Chapter 3, pp. 167, and 226–250 (New York, N.Y., Bockris et al. Editors).

As identified, a catalyst may be associated with the flow pattern associated with the fluid generated by the oxidizing agent generator in order to, for example, convert chemicals generated by the generator to more desirable agents. Catalysts for scavenging, destroying or degrading undesirable chemicals will be chosen according to the particular chemical produced by the generator. Examples of catalysts which assist in the conversion of a chemical generated by the generator into a more desirable chemical compound include gold, graphite powder, or activated carbon.

Hydrogen peroxide may be synthesized by means of electrochemically reducing oxygen in the presence of acid and halide (e.g., bromide) conducted in an electrolytic cell (at a cathode). Alternatively, a process such as that disclosed in U.S. Pat. No. 5,338,412 to Burk et al. (Aug. 16, 1994) may be used to generate a peroxide and/or oxygen with an electrochemical generator.

Rather than using the previously described electrochemical gas generating cells, an electrolytic ozone generating device such as that disclosed in U.S. Pat. No. 5,326,444 (Jul. 5, 1994) to Nakamatsu et al. or similar device may be used as the oxidizing agent generator. Alternatively, a proton-exchange-membrane electrochemical flow reactor which simultaneously oxidizes and reduces de-ionized water to form ozone and hydrogen peroxide at the anode and cathode respectively such as that disclosed in Tatapudi et al. "Simultaneous Synthesis of Ozone and Hydrogen Peroxide in a Proton-Exchange-Membrane Electrochemical Reactor", *J. Electrochem. Soc.*, 141(5):1174–1178 (The Electrochemical Society, Inc., May 1994) may be modified (e.g., by including a water reservoir within the handle stem) and incorporated into the use with the invention. Similarly, other electrochemical gas generating cells such as those U.S. Pat. No. 5,427,870 to Joshi et al. (Jun. 27, 1995). Alternatively, electrochemical cells such as those disclosed in U.S. Pat. No. 5,454,922, U.S. Pat. No. 5,538,605, or U.S. Pat. No. 5,593,552 may be used (e.g., cells based on copper hydroxide) may be used in the device.

Figure 9:
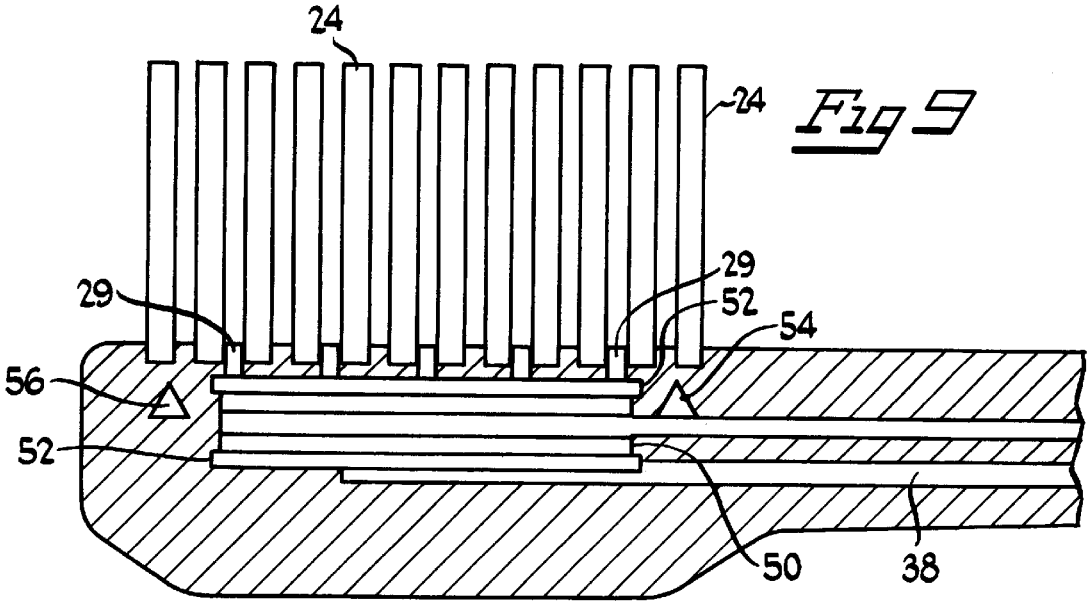
FIG. 9 depicts a close-up of the bristle portion of an alternative embodiment of the invention which also utilize ultrasonic wave generators.

As depicted in FIG. 9, the inventive brush may further include other systems, such as an ultrasonic frequency wave generator 54, 56 in conjunction with the beneficial agent generator in order to enhance the effect of the beneficial agent. In such an instance, a synergistic combination may result (e.g., in the areas of cleaning and debriding an oral surface).

In one embodiment, compounds which react to form an effervescent solution or other means (e.g., an appropriately structured electrochemical gas generating cell) are used to generate carbon dioxide bubbles which pass through the bristle or other holes to assist in the permeation of the oxidizing agent into the tooth or other surface.

Other than bristles, other surface application material (e.g., a sponge or a pad) may be affixed to the portion of the device to be applied to a surface.

Once being apprised of the instant invention, methods of making and using it will become apparent to the ordinarily skilled artisan. For instance, the stem (or stem pieces) may be injection molded out of a suitable plastic, bristles and their make up are well known to the art, electrochemical cells can be as previously described (or their equivalents may be used), suitable batteries are readily commercially available, and methods of associating the various components of the invention (e.g., adhering bristles to a toothbrush stem) are well known.

Devices according to the invention have the further advantage that even if toothpaste is unavailable to the user, some cleaning and anti-microbial effect occurs merely do the presence of the oxidizing agent in the bristles.

The invention is further explained by the following illustrative examples.

EXAMPLES

Example I

A device such as that depicted in FIG. 1 is made. It utilizes a battery and a switch (available from Radio Shack of Fort Worth, Tex.), a Nafion electrochemical oxygen gas generating cell (available from Ceramatec, Inc. of Salt Lake City, Utah), a thermoset plastic handle, and flexible plastic bristles. The electrochemical gas generating cell utilizes one electrode of Pt—Ru while the other electrode is platinum/Ir (see, e.g., U.S. Pat. No. 5,454,922 to Joshi et al.). The cell is operated at greater than 1.5 volts to generate hydrogen and oxygen gas. The hydrogen gas is directed away from the bristle area of the brush. Extra holes are formed in the bristle portion of the stem to allow oxygen to escape from the gas generating cell to the bristles.

Example II

The device of EXAMPLE I is actuated by moving the switch to the "on" position. The oxidizing agents are generated by the gas generating cell, and an oxygen-ozone mixture is formed with the assistance of the platinum catalyst. The presence of oxidizing agents is detected proximate the bristles.

Example III

The device of EXAMPLES I and II is used to brush a subject's teeth, both with and without added toothpaste (COLGATE™) in a normal manner (e.g., usual times and usual conditions). After time (e.g., three weeks), the subject's teeth begin to whiten.

Example IV

The device of EXAMPLE I is actuated by moving the switch to the "on" position. The oxidizing agents are generated by the gas generating cell, and an oxygen-ozone mixture is formed with the assistance of the $TiO_2$ catalyst. The presence of oxidizing agents is detected proximate the bristles.

Example V

The device of EXAMPLE I is actuated by moving the switch to the "on" position. The oxidizing agents are generated by the gas generating cell, and an oxygen-ozone mixture is formed with the assistance of the $PbO_2$ catalyst. The presence of oxidizing agents is detected proximate the bristles.

Although the invention has been described with regard to certain preferred embodiments and examples, the scope of the invention is to be defined by the appended claims. For instance, although the brush has been described as a toothbrush, a brush made according to the invention may be used to debride a skin wound.

What is claimed is:

1. A device for supplying an oxidizing agent for topical treatment of an oral surface, said device comprising:

a toothbrush of the type having a stem and bristles associated therewith, said bristles being oriented for application to a subject's oral surface, and an oxidizing agent generator incorporated within the toothbrush stem for supplying an oxidizing agent to the bristles for application to the oral surface wherein the oxidizing agent generator generates oxygen, hydrogen peroxide, ozone, or mixtures thereof electrochemically.

2. The device of claim 1 further comprising a light source having a wavelength greater than 180 nanometers for indicating the end or near end of the usefulness of the device.

3. A device for supplying an oxidizing agent for topical treatment of an oral surface, said device comprising:

a toothbrush of the type having a stem and bristles associated therewith, said bristles being oriented for application to a subject's oral surface, and an oxidizing agent generator incorporated within the toothbrush stem for supplying an oxidizing agent to the bristles for application to the oral surface wherein the oxidizing agent generator generates oxygen electrochemically, and includes:

a cathode for reducing oxygen in a feed gas to negative ions, neutral species, or mixtures thereof;

an electrolyte for transporting the ions, neutral species or mixtures thereof therethrough; and an anode communicating with the electrolyte for oxidizing the negative ions, neutral species or mixtures thereof to produce an oxygen gas for supply to the oral surface upon actuation of electrical circuitry operably associating said cathode, anode, and electrolyte.

4. The device of claim 3 further comprising a light source having a wavelength greater than 180 nanometers for indicating the end or near end of the usefulness of the device.

5. The device of claim 3 wherein the generation of oxygen occurs according to a one, two or four electron process.

6. The device of claim 3 wherein the negative ions are peroxide ions in their various protonated and unprotonated forms.

7. The device of claim 3 wherein the negative ions are superoxide ions including their protonated form.

8. A device for supplying an oxidizing agent for topical treatment of an oral surface, said device comprising:

a toothbrush of the type having a stem and bristles associated therewith, said bristles being oriented for application to a subject's oral surface, and an oxidizing agent generator incorporated within the toothbrush stem for supplying an oxidizing agent to the bristles for application to the oral surface wherein the oxidizing agent comprises a mixture of gaseous components, said gaseous components selected from the group consisting of peroxides, oxygen, ozone and carbon dioxide.

9. The device of claim 8 further comprising a light source having a wavelength greater than 180 nanometers for indicating the end or near end of the usefulness of the device.

10. A device for supplying an oxidizing agent for topical treatment of an oral surface, said device comprising:

a toothbrush of the type having a stem and bristles associated therewith, said bristles being oriented for application to a subject's oral surface, and an oxidizing agent generator incorporated within the toothbrush stem for supplying an oxidizing agent to the bristles for application to the oral surface wherein the oxidizing agent generator generates oxygen according to an electrochemical process and includes a power source which applies a potential difference between a cathode and anode to concentrate oxygen atoms from ambient air.

11. The device of claim 10 wherein the power source is a primary or rechargeable battery.

12. The device of claim 10 further comprising a light source having a wavelength greater than 180 nanometers for indicating the end or near end of the usefulness of the device.

13. A brush comprising:

a stem having a first end and a second end, said first end serving as a handle; bristles associated with said second end of said stem; and a beneficial agent generator for delivering a beneficial agent to said bristles, said beneficial agent generator associated with said stem, and in fluid communication with at least a portion of said bristles wherein said beneficial agent generator comprises a photoelectrochemical cell, a battery, and a switch, the photoelectrochemical cell comprising a light source having a wavelength greater than 180 nanometers, and a catalyst layer, said battery and photoelectrochemical cell encased within said stem.

14. The brush of claim 13 wherein said catalyst layer comprises $TiO_2$.

15. A brush comprising:

a stem having a first end and a second end, said first end serving as a handle;

bristles associated with said second end of said stem; and a beneficial agent generator for delivering a beneficial agent to said bristles, said beneficial agent generator associated with said stem, and in fluid communication with at least a portion of said bristles wherein said beneficial agent generator is an oxidizing gas generating cell encased within said stem.

16. The brush of claim 15 wherein the beneficial agent is selected from the group consisting of oxygen, ozone, carbon dioxide, hydrogen peroxide, or mixtures thereof.

17. The brush of claim 15 wherein the beneficial agent generator comprises a corona discharge ceramic cell encased within the stem which is powered by a battery also encased within the stem.

18. The brush of claim 15 further comprising a switch for activating and deactivating said gas generating cell, said switch associated with the first end of the stem and in operable connection with the gas generating cell.

19. The brush of claim 15 further comprising:

a battery encased within the first end of the stem.

20. The brush of claim 19 further comprising a switch for activating and deactivating said gas generating cell associated with the first end of the stem and in electrical contact with the gas generating cell and said battery.

21. The brush of claim 15 wherein fluid generated by said beneficial agent generator contains at least one oxidizing agent selected from the group of oxidizing agents consisting of peroxides, ozone, oxygen and mixtures thereof.

22. The brush of claim 21 wherein the oxidizing agent includes hydrogen peroxide, ozone, or mixtures thereof.

23. The brush of claim 15 further comprising a vent, in fluid communication with said gas generating cell, for venting undesired fluids from said second end of the toothbrush.

24. The brush of claim 23, wherein said vent vents the undesired fluids to the first end of the stem.

25. The brush of claim 15 further comprising a catalyst positioned proximal said gas generating cell.

26. The brush of claim 15, wherein the stem comprises two interconnectible portions, a first portion associated with said first end, and a second portion associated with said second end.

27. The brush of claim 26, wherein the beneficial agent generator is enclosed within said first portion.

28. The brush of claim 26, wherein said second portion comprises a tubular member having a lumen, the lumen providing fluid communication between the beneficial agent generator and the bristles.

29. The brush of claim 15 wherein the brush further comprises an ultrasonic frequency wave generator in conjunction with said beneficial agent generator in order to enhance the effect of the beneficial agent.

30. The brush of claim 15 wherein at least a portion of said bristles are comprised of a conductive material, and a plurality thereof serve as an anode and a cathode, and wherein a power supply is encased within the stem and is in operable electrical connection with the anode and cathode.

31. The device of claim 15 further comprising a light source having a wavelength greater than 180 nanometers for indicating the end or near end of the usefulness of the device.

32. An improvement in a brush of the type having a handle and associated means for surface application, the improvement comprising:

encasing an electrochemical gas generation cell within said handle in such a manner that gas generated by said electrochemical gas generation cell is in fluid communication with said means for surface application.

33. The improvement of claim 32 wherein said means for surface application includes bristles.

34. A method of treating a tooth's surface comprising:

providing a toothbrush comprising:

a stem having first and second ends said first end serving as a handle, bristles associated with said second end of said stem, means for generating a fluid comprising an oxidizing agent, said means associated with said stem, and an actuator operably associated with said means for generating a fluid; actuating said actuator and brushing said tooth surface with said bristles for a period of time wherein said means for generating a fluid comprising an oxidizing agent is a gas generating cell partially encased within the second end of the stem associated with the bristles.

35. The method of claim 34, wherein the oxidizing agent comprises hydrogen peroxide.

36. The method of claim 34, wherein the toothbrush further comprises means, in fluid communication with said gas generating cell, for venting undesired fluids from said second end of the toothbrush.

* * * * *